US012089643B2

(12) United States Patent
Zhou

(10) Patent No.: US 12,089,643 B2
(45) Date of Patent: Sep. 17, 2024

(54) HEATING PIECE FOR ATOMIZER, ATOMIZER, AND ELECTRONIC CIGARETTE

(71) Applicant: SHENZHEN DORTEAM TECHNOLOGY LIMITED, Shenzhen (CN)

(72) Inventor: Xuewu Zhou, Shenzhen (CN)

(73) Assignee: Shenzhen Dorteam Technology Limited, Shenzhen (CN)

( * ) Notice: Subject to any disclaimer, the term of this patent is extended or adjusted under 35 U.S.C. 154(b) by 623 days.

(21) Appl. No.: 17/309,385

(22) PCT Filed: Jul. 16, 2019

(86) PCT No.: PCT/CN2019/096164
§ 371 (c)(1),
(2) Date: May 24, 2021

(87) PCT Pub. No.: WO2021/007776
PCT Pub. Date: Jan. 21, 2021

(65) Prior Publication Data

US 2022/0125108 A1 Apr. 28, 2022

(51) Int. Cl.

| | |
|---|---|
| ***A24F 40/46*** | (2020.01) |
| ***A24F 40/10*** | (2020.01) |
| ***A24F 40/42*** | (2020.01) |
| ***A24F 40/44*** | (2020.01) |

(52) U.S. Cl.
CPC ..... *A24F 40/46* (2020.01); *A24F 40/44* (2020.01); *A24F 40/10* (2020.01); *A24F 40/42* (2020.01)

(58) Field of Classification Search
CPC ..... A24F 40/46; A24F 40/44; A24F 40/10; A24F 40/42
USPC ..... 131/329
See application file for complete search history.

(56) References Cited

U.S. PATENT DOCUMENTS

| | | | | |
|---|---|---|---|---|
| 9,226,525 | B2 * | 1/2016 | Liu | H05B 1/0202 |
| 9,877,509 | B2 * | 1/2018 | Dai | A24F 40/46 |
| 2014/0130816 | A1 * | 5/2014 | Liu | A24F 40/46 392/394 |
| 2016/0015082 | A1 * | 1/2016 | Liu | A24F 40/44 131/329 |
| 2016/0309786 | A1 * | 10/2016 | Holtz | H05B 3/06 |
| 2017/0042228 | A1 * | 2/2017 | Liu | A24F 40/50 |
| 2017/0215474 | A1 * | 8/2017 | Li | A24F 40/485 |
| 2017/0215481 | A1 * | 8/2017 | Li | H05B 3/42 |
| 2017/0224018 | A1 * | 8/2017 | Li | A24F 40/46 |

(Continued)

*Primary Examiner* — Gary F Paumen
(74) *Attorney, Agent, or Firm* — Rosenberg, Klein & Lee

(57) ABSTRACT

Disclosed are a heating piece for an atomizer, the atomizer (20) and an electronic cigarette. The heating piece includes a support member (100), and a heating member (200, 500, 600, 700) and an extraction electrode (800) disposed on the support member (100) and coupled with one another. The support member (100) or heating member (200, 500, 600, 700) has through holes. The heating piece is a mesh-shaped structure capable of achieving uniform heating, avoiding scorching of e-liquid, guiding an e-liquid smoothly, and providing good stability. A condensate flows back by means of a support slope (8) and passes through the through hole of the heating piece (5), permeates into a liquid guide cotton (10), and enters into an atomization chamber (9) for further atomization.

16 Claims, 11 Drawing Sheets

(56) References Cited

U.S. PATENT DOCUMENTS

2018/0263285 A1* 9/2018 Kleizo ..... A24F 40/40
2018/0317559 A1* 11/2018 Qiu ..... A24F 40/485

* cited by examiner

HEATING PIECE FOR ATOMIZER, ATOMIZER, AND ELECTRONIC CIGARETTE

FIELD OF THE INVENTION

The present invention relates to the field of electronic cigarettes, in particular to a heating piece for an atomizer, the atomizer, and an electronic cigarette.

BACKGROUND OF THE INVENTION

At present, most electronic cigarettes on the market heat up and atomize an e-liquid by a traditional ceramic core or cotton core, so that users can inhale the atomized e-liquid. However, the e-liquid condensed after the atomization may flow out from an air passage easily, and thus causing a waste and a poor taste. In addition, the taste of the e-liquid heated and atomized by the ceramic core or cotton core is not good, and the degree of reduction of the e-liquid is not high, which affects the user's experience of the electronic cigarette.

SUMMARY OF THE INVENTION

An objective of the present invention is to overcome the aforementioned technical problem by providing a heating piece for an atomizer, the atomizer, and an electronic cigarette, wherein the heating piece adopts a mesh heating material and a condensate backflow and use to optimize the atomization effect and provide a high degree of reduction of an e-liquid and a full amount of smoke.

To achieve the aforementioned and other objectives, the present invention discloses a heating piece for an atomizer, and the heating piece comprises a support member, a heating member and an extraction electrode disposed on the support member and coupled to each other; and the support member or the heating member has a plurality of through holes formed thereon.

In the present invention, the heating piece for an atomizer is disposed on a side of the liquid guide cotton, and an e-liquid or a condensate can be permeated through the through holes of the heating piece into the liquid guide cotton, and the heating piece has meshes, which are equivalent to the gaps of the heating member and will provide a more uniform heating effect without concentrating the heat at any particular position and achieve the effects of a high degree of reduction of the e-liquid and a full amount of smoke. Unlike the mesh heating of the traditional heating wire system that adopts a ceramic rod cotton core heating wire and has the drawbacks of too-concentrated heat and low temperature stability and uniformity that result in low heating efficiency, poor taste of the atomized e-liquid, easy burn of the e-liquid, unsmooth oil, and low stability. On the other hand, the mesh heating of the present invention has the advantages of sufficient atomization, high stability, and uniform atomization of each molecule of the e-liquid. In addition, the durability of the mesh heating and the repeated heating without deformation or carbon deposit are not achievable by traditional heating methods.

As a further improvement of the present invention, the support member is a ceramic plate or a glass plate, and the through holes are formed on the ceramic plate or the glass plate, and the heating member is a heating wire or a printed resistor. Further, the heating wire is wound inside the through hole. In this technical solution, the support member can be a ceramic plate, wherein the porous ceramic plate is sintered and then the printed resistor is printed. The support member can also be a porous glass plate or ceramic plate, wherein the porous glass plate or ceramic plate is sintered, and then the heating wire is uniformly wound between the holes and attached closely to the glass plate or the ceramic plate.

As a further improvement of the present invention, the support member is a ceramic or glass border frame, and the heating member is a metal heating piece having a plurality of through holes and disposed in the ceramic or glass border frame. In this technical solution, the ceramic border frame or the glass border frame is manufactured first, and the heating piece is formed by etching a thin steel sheet to achieve the desired resistance, and then the extraction electrode and the thin steel sheet are welded to each other.

As a further improvement of the present invention, the support member and the heating member are integrated with each other to form a metal plate, the metal plate has a plurality of through holes formed thereon, and the metal plate and the extraction electrode are coupled to each other. In this technical solution, the metal plate is formed by a metal sheet and etched to form the through holes, so as to achieve the desired resistance, and then the extraction electrode and the thin steel sheet are welded to each other.

As a further improvement of the present invention, the support member comprises a micropore powder sintered ceramic plate, and the heating member is formed by sintering the metal material added with a ceramic powder during the sintering process.

As a further improvement of the present invention, the through holes are arranged in a matrix on the support member or the heating member.

The present invention further discloses an atomizer, comprising:

a shell, having an the air intake passage formed at the bottom of the shell, an exhaust pipe disposed at an upper middle portion in the shell, and an oil tank, a mesh-shaped heating piece and a support seat disposed in the shell;

wherein, the mesh-shaped heating piece is the heating piece for an atomizer as claimed in any one of claims 1 to 4; the support seat is disposed under the oil tank, and the support seat comprises a support slope with a low end disposed on a side of the mesh-shaped heating piece and an atomization chamber formed on the other side of the mesh-shaped heating piece, and the atomization chamber has an oil guide cotton attached onto the mesh-shaped heating piece;

the oil tank disposed above the oil guide cotton has an oil outlet;

the air intake passage has an air outlet disposed on a side of the mesh-shaped heating piece; a condensate collected by the support slope is passed through a plurality of meshes of the mesh-shaped heating piece and permeated into the oil guide cotton, and then heated and atomized by the mesh-shaped heating piece.

In this technical solution, the oil in the oil tank is passed through the liquid guide cotton to the heating material for heating and atomization, and the condensate collected from the support slope is passed through the through holes of the heating piece and permeated into the atomization chamber of the liquid guide cotton for recycle and re-atomization, and the heating piece has a plurality of meshes to provide the effects of uniform heating effect, high degree of reduction of the e-liquid, full amount of smoke, sufficient atomization and good stability. In addition, the air is entered from the air intake passage at the bottom, and the airflow directly impacts the heating module to carry away the atomized steam.

As a further improvement of the present invention, the support seat has a condensate recycle tank disposed therein and under the support slope and communicated with the atomization chamber for recycling extra condensate and prevent oil leakage.

Further, the condensate recycle tank has absorbent cotton disposed therein.

As a further improvement of the present invention, the bottommost mesh of the mesh heating piece is no higher than a low end of the support slope.

As a further improvement of the present invention, the air intake passage is passed through and extended out from the support slope, and the air intake passage has an air outlet higher than the support slope of the support seat to prevent the condensate from permeating out from the bottom.

As a further improvement of the present invention, the air outlet of the air intake passage is an opening facing a side of the mesh heating piece. Air is discharged from a side of an end of the air intake passage, so that the airflow directly impacts the mesh heating piece to thoroughly carry away the atomized steam.

As a further improvement of the present invention, the mesh heating piece is sealed and coupled to the shell through the sealing ring, so as to seal the atomization chamber.

As a further improvement of the present invention, the bottom of the oil tank is a slope to facilitate the complete utilization of the e-liquid and achieve zero waste.

As a further improvement of the present invention, the atomizer has an atomization cover, and the atomization cover has a nozzle communicated with the exhaust pipe, and absorbent cotton is installed under the nozzle, and the atomization cover is coupled to the shell of the atomizer through the sealing cover.

Further, the nozzle is made of a polypropylene (PP) material, and the oil tank is made of a poly-cyclohexylenedimethylene terephthalate glycol (PCTG) food grade material.

As a further improvement of the present invention, the atomizer has a base, and the base is engaged with the support seat through the silicone ring.

Further, the bottom of the atomizer has a magnet. Further, the bottom of the atomizer has two magnets tightly fitted to the base.

The present invention further discloses an electronic cigarette, comprising a battery tube and the atomizer according to any one of the aforementioned embodiments, and the battery tube has a battery installed therein and coupled to a main processing unit, and an end of the battery tube has a spring contact and a magnet electrically coupled to the extraction electrode of the mesh heating piece of the atomizer, and the main processing unit is coupled to the spring contact. In this technical solution, the battery tube and the atomizer are configured to touch each other by a magnet to achieve the effects of precise positioning and quick and convenient installation.

Further, the spring contact is a 2-pin spring contact for a convenient use.

Further, the spring contact is extended out from the top of the battery tube and sealed to the battery tube by sealing silicone prevent oil leakage that may damage the components in the battery tube and the battery.

As a further improvement of the present invention, the battery tube comprises a battery bracket, a charge plate, a microphone, a light guide, the battery, and a main processing unit disposed inside the battery bracket; and the battery is coupled to the charge plate, and the microphone is coupled to the main processing unit. The microphone can be switched on to achieve the plug and play effect and provide a quick and convenient use.

As a further improvement of the present invention, the charge plate has a charging interface disposed at the other end of the battery tube.

Further, the battery tube is made of an aluminum alloy material to provide a simple and elegant appearance and diversified colors.

The present invention has the following advantageous effects:

In the technical solution of the present invention, The heating piece for an atomizer adopts the heating piece with a mesh-shaped structure and thus achieves more uniform heating, avoids scorching of the e-liquid, guides the e-liquid smoothly, and has good stability. Condensate flows back for utilization by means of a support slope, infiltrates into liquid guide cotton through the through holes of the heating piece, and enters into an atomization chamber for further atomization. Therefore, the reduction degree of the e-liquid is high, the amount of smoke is full, and a better atomizing taste is achieved. In addition, the problem in the prior art of proneness of the atomized condensate e-liquid to flow out from an air passage is overcome.

SUMMARY OF THE INVENTION

DESCRIPTION OF THE PREFERRED EMBODIMENTS

The aforementioned and other objectives and advantages of this disclosure will become clearer in light of the following detailed description of an illustrative embodiment of this invention described in connection with the drawings.

Figure 1:
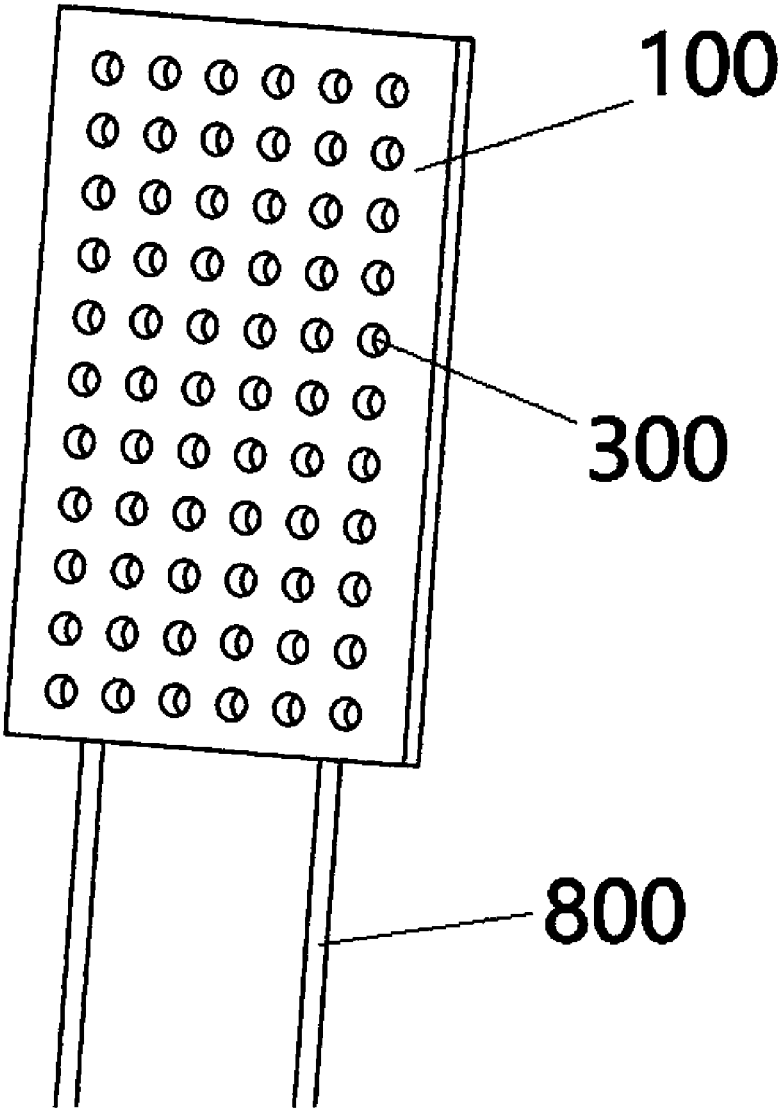
FIG. 1 is a schematic view showing the structure of a heating piece for an atomizer in accordance with a first embodiment of this invention.

With reference to FIG. 1 for a heating piece for an atomizer in accordance with the first embodiment of this invention, the heating piece comprises a support member 100 which is a ceramic plate and has a plurality of through holes 300 uniformly arranged into a matrix, and a heating member and an extraction electrode 800 disposed on the support member 100 and the heating member being coupled to the extraction electrode 800. In this embodiment, the heating member is a printed resistor (not shown in the figure) formed by sintering a conductive paste on a ceramic plate through screen printing.

Figure 2:
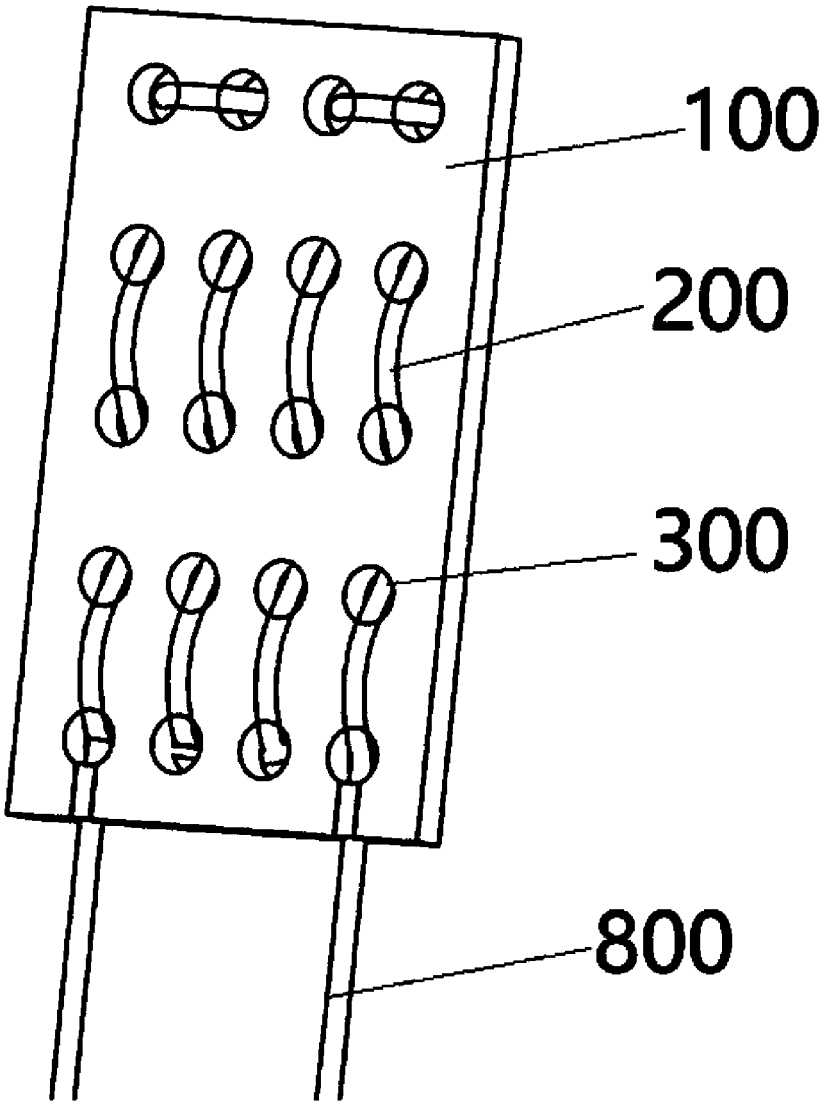
FIG. 2 is a schematic view showing the structure of a heating piece for an atomizer in accordance with a second embodiment of this invention.

With reference to FIG. 2 for a heating piece for an atomizer in accordance with the second embodiment of this invention, the heating piece comprises a support member 100 which is a glass plate or a ceramic plate and has a plurality of through holes 300 uniformly arranged into a matrix, a heating wire 200 passing through and around the through hole 300 and attaching closely to the support member 100, and both ends of the heating wire 200 being used as extraction electrodes 800, or both ends of heating wire 200 being soldered with extraction electrodes 800 respectively.

In this manufacturing method, a porous glass plate or ceramic plate is sintered, and then the heating wire 200 is wound around the holes uniformly, so that the heating wire 200 is attached closely to the glass plate or ceramic plate.

Figure 3:
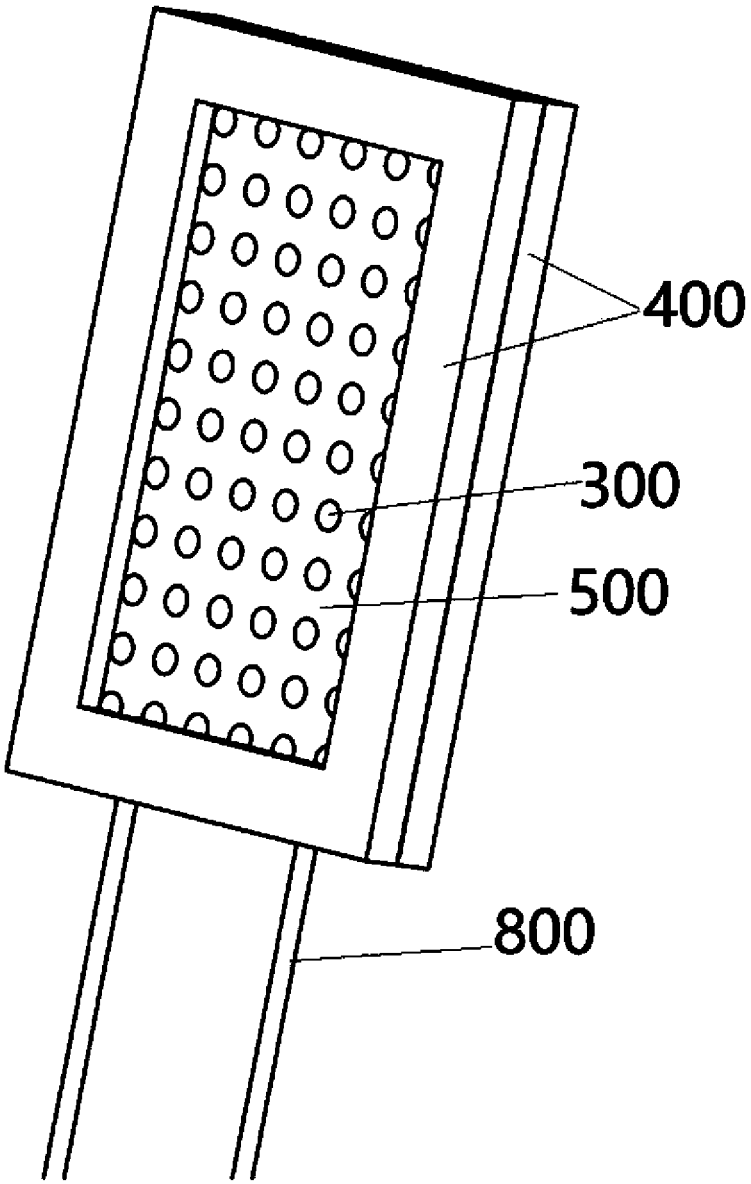
FIG. 3 is a schematic view showing the structure of a heating piece for an atomizer in accordance with a third embodiment of this invention.

With reference to FIG. 3 for a heating piece for an atomizer in accordance with the third embodiment of this invention, the heating piece comprises an insulating border frame 400 made of ceramic or glass, a heating member which is a metal heating piece 500 having a plurality of through holes 300 and disposed within an insulating border frame 400 made of ceramic or glass, and the two insulating border frames 400 being engaged to fix the metal heating piece 500. In this technical solution, the ceramic border frame or glass border frame is manufactured first, and then the heating piece is formed by etching a thin steel sheet to achieve a desired resistance, and finally the extraction electrode 800 and the thin steel sheet are welded to each other.

Figure 4:
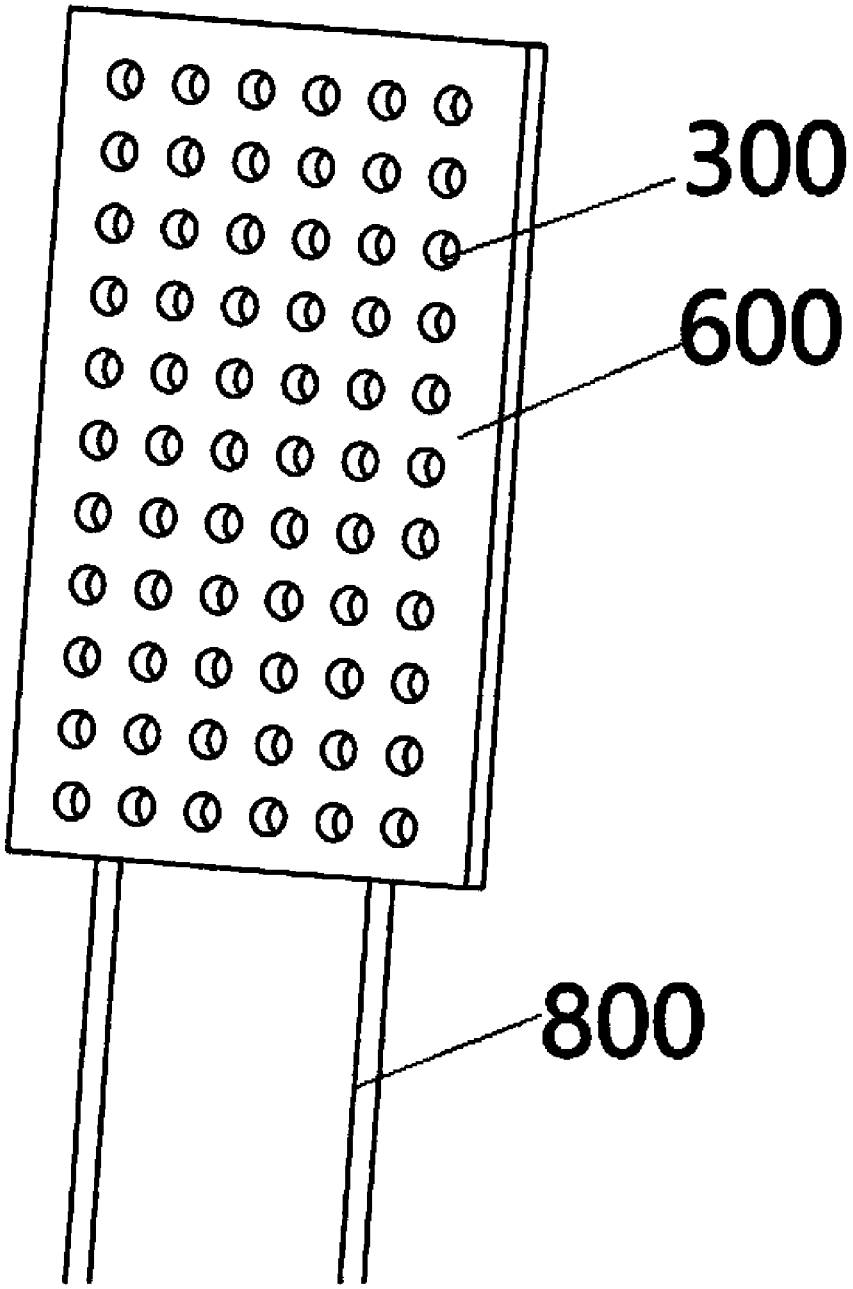
FIG. 4 is a schematic view showing the structure of a heating piece for an atomizer in accordance with a fourth embodiment of this invention.

With reference to FIG. 4 for a heating piece for an atomizer in accordance with the fourth embodiment of this invention, a support member and a heating member of this embodiment are integrated with each other to form a metal plate 600, and the metal plate 600 has a plurality of through holes 300. The through holes 300 of the metal plate 600 are formed by etching a steel sheet to achieve the desired resistance, and then the extraction electrode 800 and the thin steel sheet are welded to each other.

Figure 5:
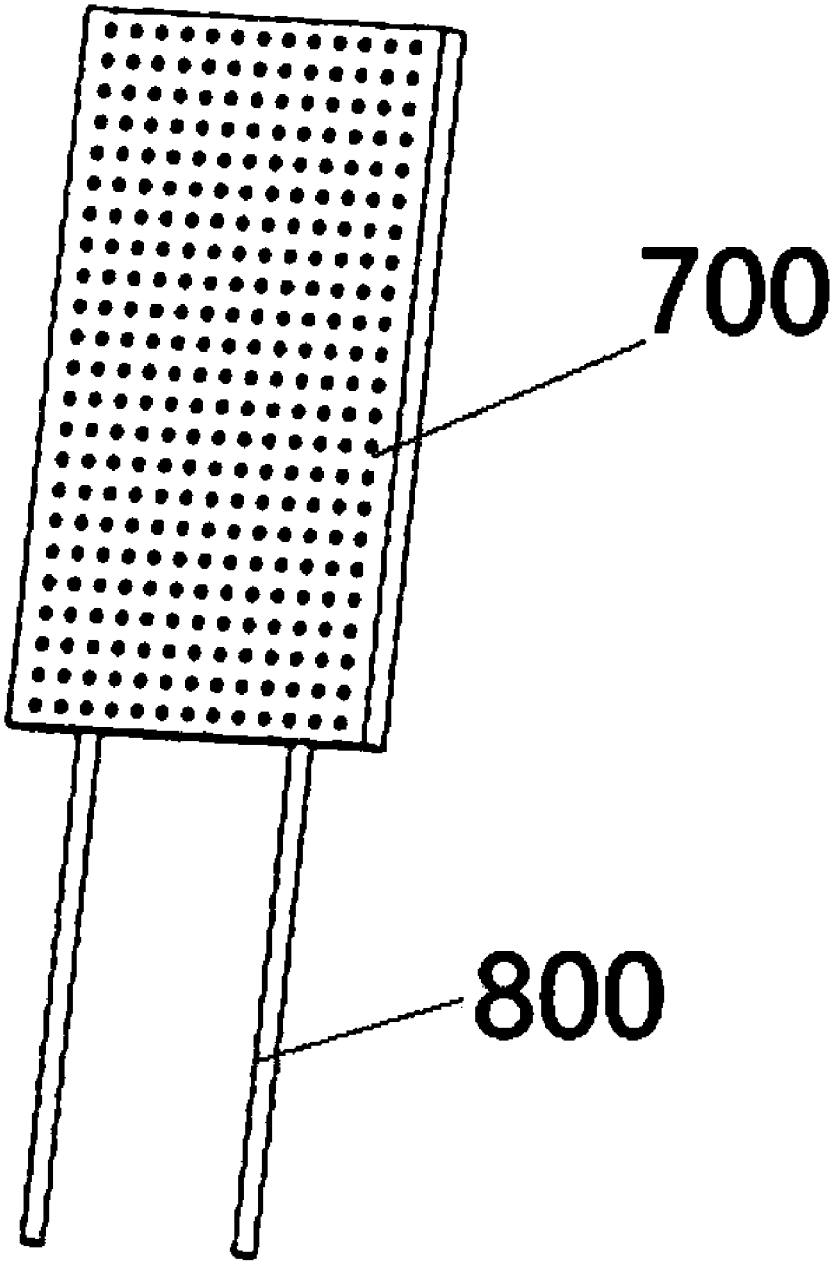
FIG. 5 is a schematic view showing the structure of a heating piece for an atomizer in accordance with a fifth embodiment of this invention.

With reference to FIG. 5 for a heating piece for an atomizer in accordance with the fifth embodiment of this invention, the heating piece comprises a micropore powder ceramic sintered heating piece 700 with micropores, and the heating member is formed by adding ceramic powder into a metal material during a sintering process and then sintering the mixture, and the extraction electrode 800 is coupled to the metal material of the heating piece.

In this embodiment, the ceramic powder is sintered, and a gap reserved between the powder particles form an oil guide path, and a heating material is added during the sintering process, and the heating member is formed after the sintering, and then the extraction electrode 800 is formed.

Figure 6:
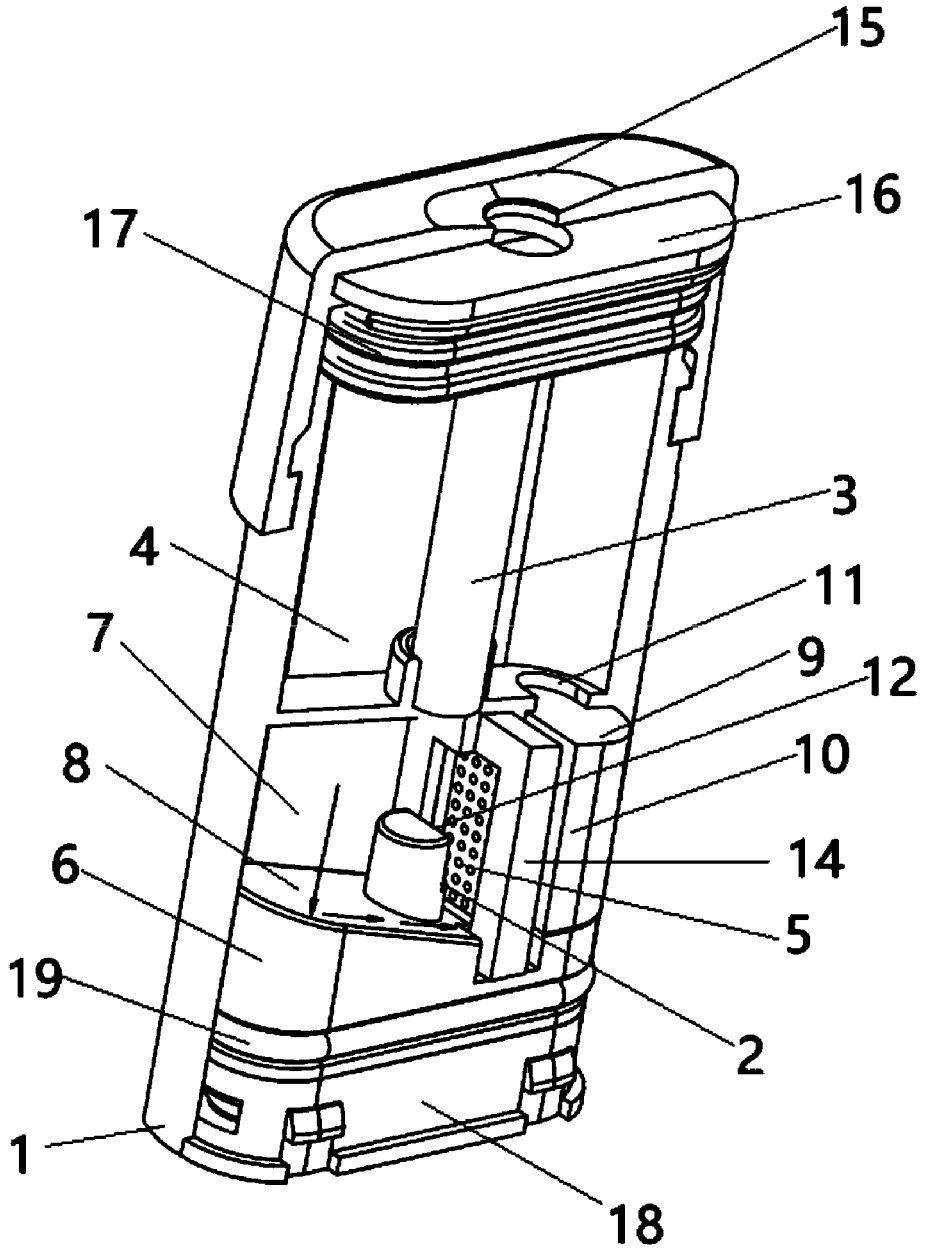
FIG. 6 is a schematic view showing the internal structure of an atomizer in accordance with a sixth embodiment of this invention.
Figure 7:
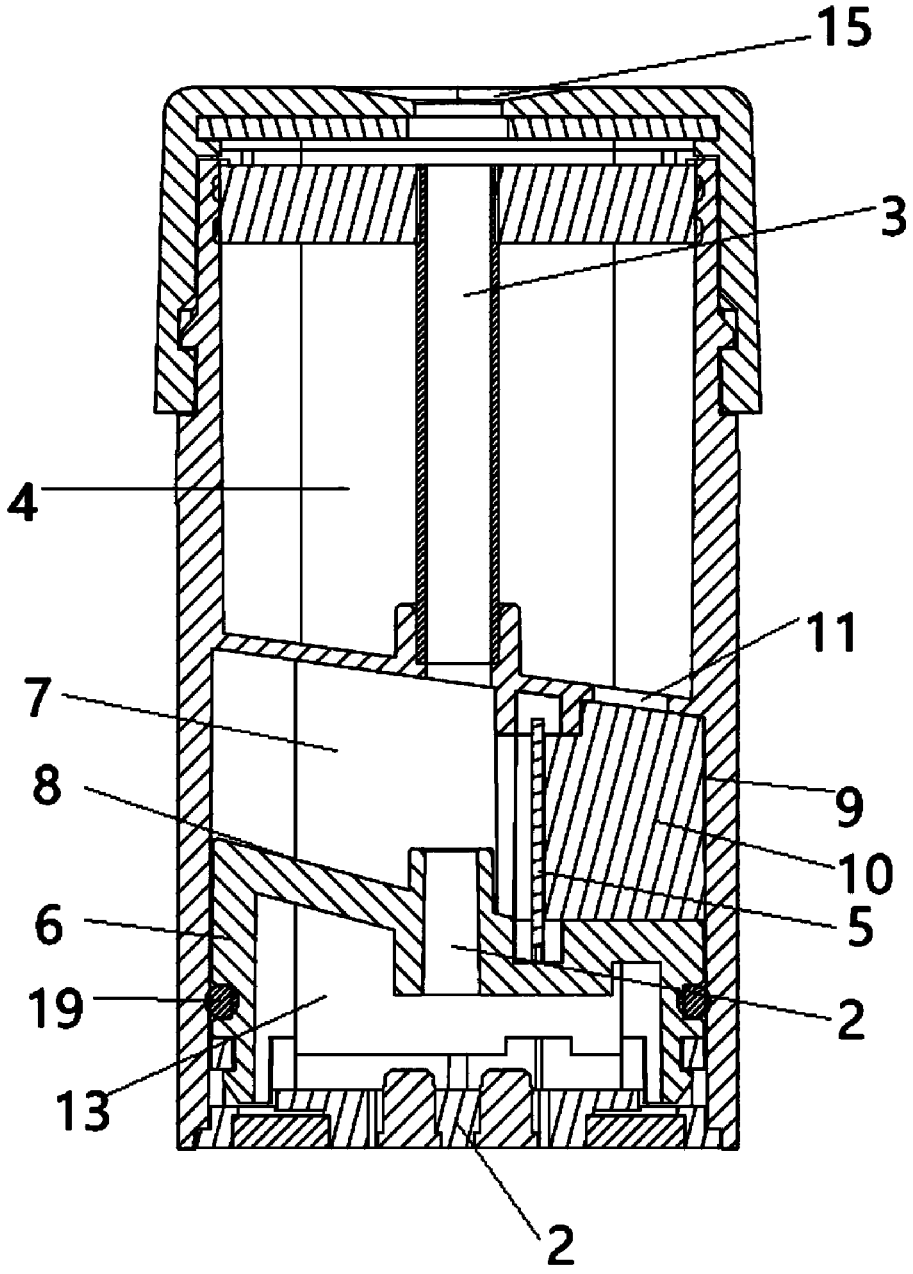
FIG. 7 is a schematic view showing a cross-sectional structure of an atomizer in accordance with the sixth embodiment of this invention.
Figure 8:
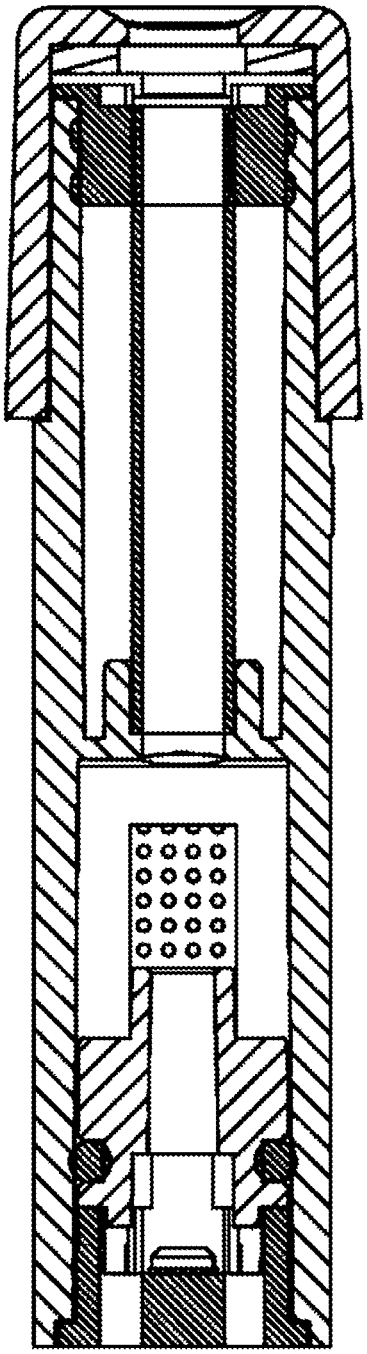
FIG. 8 is a schematic view showing another cross-sectional structure of an atomizer in accordance with the sixth embodiment of this invention.

With reference to FIGS. 6 to 8 for an atomizer in accordance with the sixth embodiment of this invention, the atomizer comprises a shell 1 having an air intake passage 2 formed at the bottom of the shell 1, an exhaust pipe 3 disposed at the upper middle portion inside the shell 1, and an oil tank 4, a mesh heating piece 5 and a support seat 6 disposed inside the shell;

The mesh heating piece 5 is the heating piece for an atomizer as described in any one of the first to fifth embodiments.

The support seat 6 is disposed under the oil tank 4, and a condensate recycle and reuse tank 7 is disposed between the support seat 6 and the oil tank 4.

The support seat 6 comprises a support slope 8 having a low end disposed on a side of the mesh heating piece 5, and an atomization chamber 9 formed on the other side of the mesh heating piece 5, and the atomization chamber 9 has a liquid guide cotton 10 attached to the mesh heating piece 5; and the oil tank 4 has an oil outlet 11 disposed above the liquid guide cotton 10.

The air intake passage 2 is passed through the support slope 8 and extended to the outside, and the air outlet 12 of the air intake passage 2 is disposed on a side of the mesh heating piece 5, and the bottom of the air outlet 12 is higher than the support slope 8 of the support seat 6 to prevent any condensate from permeating from the bottom to the outside. The air outlet 12 of the air intake passage 2 is an opening facing a side of the mesh heating piece 5 and provided for discharging air from an outlet of the air intake passage 2, and airflow directly impacts the mesh heating piece 5 to thoroughly carry away the atomized steam.

The bottommost mesh of the mesh heating piece 5 is no higher than a low end of the support slope 8 in order to maximize the use of recycled condensate. The bottom of the oil tank 4 is a slope to facilitate a complete utilization of the e-liquid and achieve zero waste. In the support seat 6, a condensate recycle tank 13 is disposed under the support slope 8 and communicated with the atomization chamber 9, and the condensate recycle tank 13 has an absorbent cotton 16 installed therein for recycling extra condensates and prevent oil leakage. The mesh heating piece 5 is sealed and coupled with the shell 1 through the sealing ring 14 in order to seal the atomization chamber 9.

The atomizer 20 has an atomization cover with a nozzle 15, and the nozzle 15 is communicated with the exhaust pipe 3. The absorbent cotton 16 is installed under the nozzle 15, and the atomization cover is coupled to the shell 1 of the atomizer 20 through a sealing cover 17. The atomizer 20 has a base 18, and the base 18 is engaged with the support seat 6 through the silicone ring 19. The extraction electrode of the mesh heating piece 5 is extended out from the base 18. Further, the bottom of the atomizer 20 has two magnets and tightly fitted with the base 18. Further, the nozzle 15 is made of a polypropylene (PP) material, and the oil tank 4 is made of a poly-cyclohexylenedimethylene terephthalate glycol (PCTG) food grade material.

In the present invention, the oil in the oil tank 4 is passed through the liquid guide cotton 10 to the heating material for heating and atomization, and the condensate collected by the support slope 8 is passed through the through hole of the heating piece and permeated into the atomization chamber 9 of the liquid guide cotton 10 for recycle and re-atomization, and finally heated and atomized by the mesh heating piece 5. In addition, air is entered from the air intake passage 2 at the bottom, and the airflow directly impacts the heating module to carry away the atomized steam. The mesh heating piece 5 has a plurality of meshes to achieve the effects of uniform heating, high degree of reduction of the e-liquid, full amount of smooth, sufficient atomization, and high stability.

Figure 9:
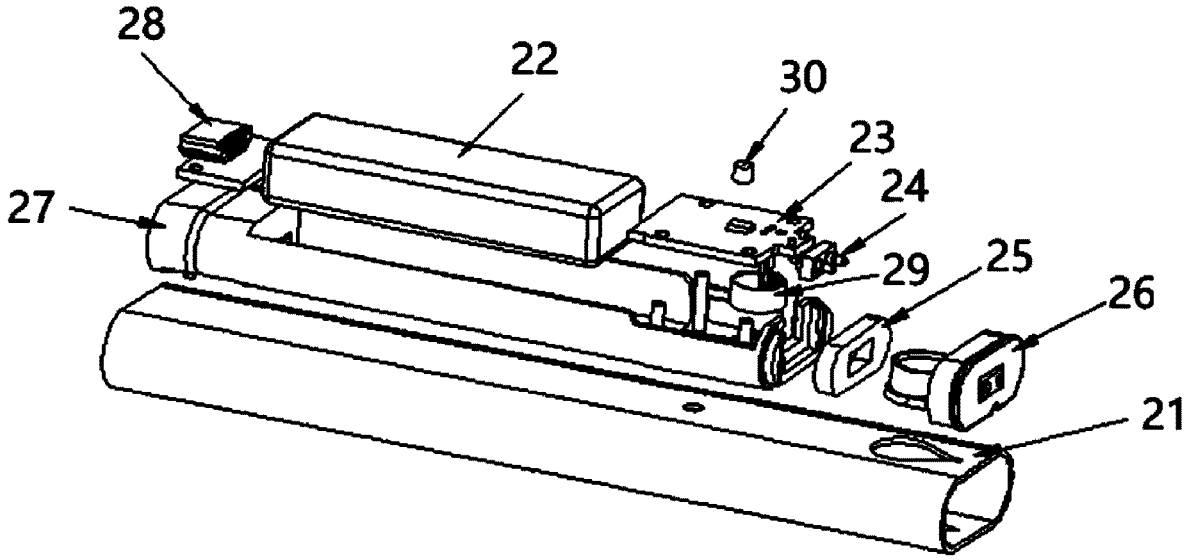
FIG. 9 is a schematic view showing the structure of a battery tube of an electronic cigarette in accordance with a seventh embodiment of this invention.
Figure 10:
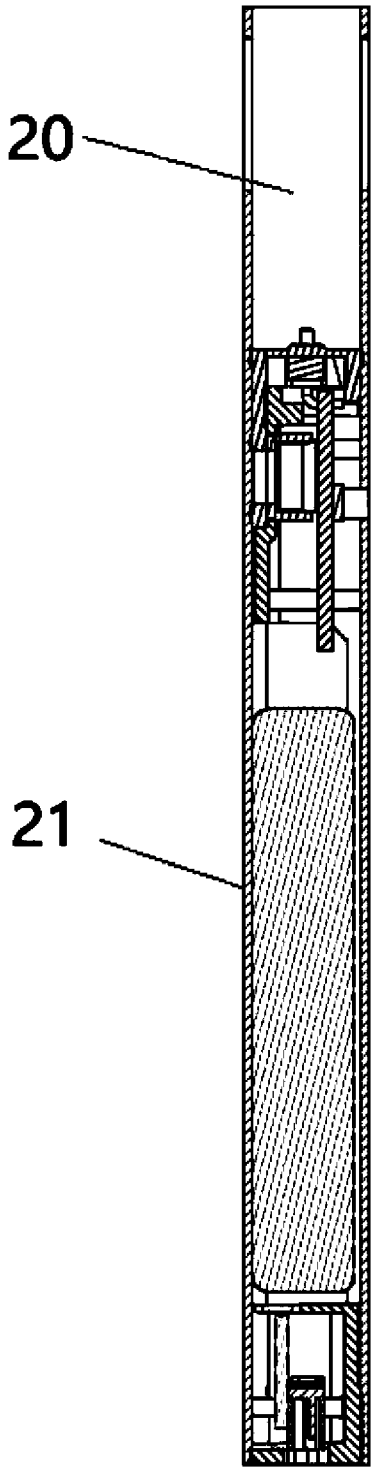
FIG. 10 is a schematic view showing an assembled structure of a battery tube and an atomizer in accordance with the seventh embodiment of this invention.
Figure 11:
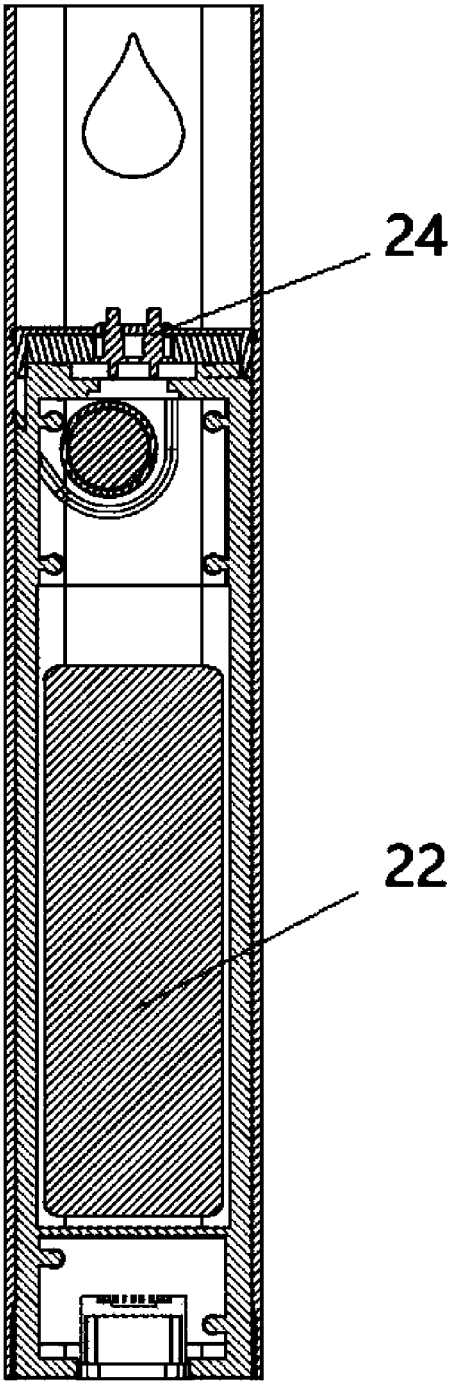
FIG. 11 is a schematic view showing another assembled structure of a battery tube and an atomizer in accordance with the seventh embodiment of this invention.

With reference to FIGS. 9 to 11 for an electronic cigarette in accordance with the sixth embodiment of this invention, the electronic cigarette comprises a battery tube 21 and the atomizer 20 as disclosed in the sixth embodiment, and the battery tube 21 includes a battery 22 installed therein, and the battery 22 is coupled to a main processing unit 23, and an end of the battery tube 21 has a 2-pin spring contact 24 and a magnet 25 electrically coupled to an extraction electrode 800 of the mesh heating piece 5 of the atomizer 20, and the main processing unit 23 is coupled to the 2-pin spring contact 24. The 2-pin spring contact 24 is extended out from the top of the battery tube 21 and sealed with the battery tube 21 through a sealing silicone ring 26 to prevent oil leakage.

The battery tube 21 comprises a battery bracket 27, a charge plate 28, a microphone 29, and a light guide 30, the battery 22 and the main processing unit 23 disposed in the battery bracket 27; and the battery 22 is coupled to the charge plate 28, and the microphone 29 is coupled to the main processing unit 23. The microphone 29 can be switched on to achieve the plug and play function and provide a quick and convenient use. The charge plate 28 has a charging interface disposed on the other end of the battery tube 21.

Further, the battery tube 21 is made of an aluminum alloy material to provide a simple and elegant appearance and diversified colors.

In this embodiment, the battery tube 21 and the atomizer 20 are configured to be in touch with each other through the magnet 25 to achieve the effects of precise positioning and quick and convenient installation.

While the invention is described in some detail hereinbelow with reference to certain illustrated embodiments, it is to be understood that there is no intent to limit it to those embodiments. On the contrary, the aim is to cover all modifications, alternatives and equivalents falling within the spirit and scope of the invention as defined by the appended claims.

What is claimed is:

1. A heating piece for an atomizer, comprising:

a support member;

a heating member and an extraction electrode, disposed on the support member, and coupled to each other; and the support member or heating member has a plurality of through holes formed thereon, wherein the support member is a ceramic or glass border frame, and the heating member is a metal heating piece having a plurality of through holes and disposed in the ceramic or glass border frame.

2. An atomizer, comprising: a shell, having an the air intake passage formed at the bottom of the shell, an exhaust pipe disposed at an upper middle portion in the shell, and an oil tank, a mesh-shaped heating piece and a support seat disposed in the shell; the support seat is disposed under the oil tank, and the support seat comprises a support slope with a low end disposed on a side of the mesh-shaped heating piece and an atomization chamber formed on the other side of the mesh-shaped heating piece, and the atomization chamber has an oil guide cotton attached onto the mesh-shaped heating piece; the oil tank disposed above the oil guide cotton has an oil outlet, the air intake passage has an air outlet disposed on a side of the mesh-shaped heating piece; a condensate collected by the support slope is passed through a plurality of meshes of the mesh-shaped heating piece and permeated into the oil guide cotton, and then heated and atomized by the mesh-shaped heating piece.

3. The atomizer as claimed in claim 2, wherein a bottom-most mesh of the mesh-shaped heating piece is no higher than a low end of the support slope.

4. The atomizer as claimed in claim 3, wherein the air intake passage is extended through the support slope to the outside, and the air outlet of the air intake passage is higher than the support slope of the support seat.

5. The atomizer as claimed in claim 4, wherein the air outlet of the air intake passage is an opening facing a side of the mesh-shaped heating piece, and the mesh-shaped heating piece is sealed and coupled with the shell through the sealing ring.

6. The atomizer as claimed in claim 2, wherein the oil tank has a bottom which is a slope; the bottom of the support slope has a condensate recycle tank disposed thereunder and communicated with the atomization chamber; the atomizer has an atomization cover, and the atomization cover has a nozzle communicated with the exhaust pipe, and the bottom of the nozzle has an oil absorbent cotton, and the atomization cover is coupled to the shell of the atomizer through the sealing cover; and the atomizer has a base engaged with the support seat through the silicone ring.

7. The atomizer as claimed in claim 2, wherein the heating piece for an atomizer comprises: a support member; a heating member and an extraction electrode, disposed on the support member, and coupled to each other; and the support member or heating member has a plurality of through holes formed thereon.

8. The atomizer as claimed in claim 2, wherein the support member is a ceramic plate or a glass plate, and the through holes are disposed on the ceramic plate or the glass plate, and the heating member is a heating wire or a printed resistor.

9. The atomizer as claimed in claim 2, wherein the support member is a ceramic or glass border frame, and the heating member is a metal heating piece having a plurality of through holes and disposed in the ceramic or glass border frame.

10. The atomizer as claimed in claim 2, wherein the support member and the heating member are integrated with each other to form a metal plate, and the metal plate has a plurality of through holes formed thereon, and the metal plate is coupled to the extraction electrode; or the support member comprises a micropore powder sintered ceramic plate, and the heating member is formed by sintering the metal material added with a ceramic powder during the sintering process.

11. An electronic cigarette, comprising a battery tube and an atomizer, and the battery tube having a battery installed therein and coupled to a main processing unit, and an end of the battery tube having a spring contact and a magnet electrically coupled to an extraction electrode of a mesh-shaped heating piece of the atomizer, and the main processing unit being coupled to the spring contact; and the spring contact is extended out from the top of the battery tube and sealed with the battery tube by sealing silicone, wherein, the atomizer comprises: a shell, having an the air intake passage formed at the bottom of the shell, an exhaust pipe disposed at an upper middle portion in the shell, and an oil tank, a mesh-shaped heating piece and a support seat disposed in the shell; the support seat is disposed under the oil tank, and the support seat comprises a support slope with a low end disposed on a side of the mesh-shaped heating piece and an atomization chamber formed on the other side of the mesh-shaped heating piece, and the atomization chamber has an oil guide cotton attached onto the mesh-shaped heating piece; the oil tank disposed above the oil guide cotton has an oil outlet; the air intake passage has an air outlet disposed on a side of the mesh-shaped heating piece; a condensate collected by the support slope is passed through a plurality of meshes of the mesh-shaped heating piece and permeated into the oil guide cotton, and then heated and atomized by the mesh-shaped heating piece.

12. The electronic cigarette as claimed in claim 11, wherein a bottommost mesh of the mesh-shaped heating piece is no higher than a low end of the support slope.

13. The electronic cigarette as claimed in claim 12, wherein the air intake passage is extended through the support slope to the outside, and the air outlet of the air intake passage is higher than the support slope of the support seat.

14. The electronic cigarette as claimed in claim 13, wherein the air outlet of the air intake passage is an opening facing a side of the mesh-shaped heating piece, and the mesh-shaped heating piece is sealed and coupled with the shell through the sealing ring.

15. The electronic cigarette as claimed in claim 11, wherein the oil tank has a bottom which is a slope; the bottom of the support slope has a condensate recycle tank disposed thereunder and communicated with the atomization chamber; the atomizer has an atomization cover, and the atomization cover has a nozzle communicated with the exhaust pipe, and the bottom of the nozzle has an oil absorbent cotton, and the atomization cover is coupled to the shell of the atomizer through the sealing cover; and the atomizer has a base engaged with the support seat through the silicone ring.

16. A heating piece for an atomizer, comprising:

a support member;

a heating member and an extraction electrode, disposed on the support member, and coupled to each other, and the support member or heating member has a plurality of through holes formed thereon, wherein the support member and the heating member are integrated with each other to form a metal plate, and the metal plate has a plurality of through holes formed thereon, and the metal plate is coupled to the extraction electrode; or the support member comprises a micropore powder sintered ceramic plate, and the heating member is formed by sintering the metal material added with a ceramic powder during the sintering process.

* * * * *